United States Patent [19]

Aenishaenslin et al.

[11] 4,070,965

[45] Jan. 31, 1978

[54] SEQUENTIAL ROTARY PRINTING PRESS WEB THREADING MEANS

[75] Inventors: Werner Aenishaenslin, Egerkingen; Fritz Suter, Boll; Ulrich Pfeuti, Worb; Paul Haag, Bern, all of Switzerland

[73] Assignee: Maschinenfabrik Wifag, Bern, Switzerland

[21] Appl. No.: 738,285

[22] Filed: Nov. 3, 1976

Related U.S. Application Data

[63] Continuation of Ser. No. 571,972, April 28, 1975, abandoned.

[30] Foreign Application Priority Data

| | | |
|---|---|---|
| May 6, 1974 | Switzerland | 060393/74 |
| Apr. 28, 1975 | Switzerland | 049312/75 |

[51] Int. Cl.[2] ..... B41F 13/02

[52] U.S. Cl. ..... 101/228; 101/181; 101/219; 226/92; 198/472

[58] Field of Search ..... 101/224, 228, 219, 216, 101/212, 181; 226/92; 198/472

[56] References Cited

U.S. PATENT DOCUMENTS

| | | | |
|---|---|---|---|
| 2,253,076 | 8/1941 | Jones et al. | 226/92 |
| 2,279,467 | 4/1942 | Jones et al. | 226/92 |
| 2,944,345 | 7/1960 | Faeber | 226/92 |
| 3,167,266 | 1/1965 | Stibitz | 226/92 |
| 3,346,159 | 10/1967 | Winkler | 226/92 |
| 3,587,461 | 6/1971 | Polglase | 101/219 |
| 3,675,754 | 7/1972 | Villemand | 198/472 |
| 3,761,001 | 9/1973 | Bolza-Schunemann et al. | 101/181 |
| 3,882,792 | 5/1975 | McIntier | 197/472 |
| 3,995,553 | 12/1976 | Winterholler et al. | 101/228 |

*Primary Examiner*—Edgar S. Burr
*Assistant Examiner*—William Pieprz
*Attorney, Agent, or Firm*—Toren, McGeady and Stanger

[57] ABSTRACT

A rotary printing press assembly having a plurality of serially arranged printing units includes a chain conveyor apparatus for sequentially continuously moving a material web through the successive printing units of the assembly. The forward end of the material web to be passed through the assembly is looped about a lead-in bar which is then engaged by a chain conveyor in order to pass the web through the printing units. A pivoted pawl engaging mechanism fixed to the chain conveyor locks in engagement with a recessed cam surface of the lead-in bars while a locking bolt enters a bore in the lead-in bar to effect driving engagement between the lead-in bar and the conveyor chain. When the lead-in bar has passed through a printing unit the driving pawl is automatically disengaged from the conveyor chain of the printing unit, and for lead-in bar is transferred into engagement with the conveyor chain of a next printing unit. In this manner, the material web attached to the lead-in bar is continuously sequentially passed through the press assembly.

5 Claims, 7 Drawing Figures

SEQUENTIAL ROTARY PRINTING PRESS WEB THREADING MEANS

This is a continuation of application Ser. No. 571,972 filed Apr. 28, 1975 now abandoned.

BACKGROUND OF THE INVENTION

The present invention relates generally to rotary printing presses and more particularly to an arrangement for inserting an endless material web into a rotary press and for conveying the web therethrough.

Paper inserting devices related to the type of device with which the present invention is concerned have been previously known in the art. For example, in German Pat. No. 1,099,554 there is disclosed a device wherein a narrow auxiliary web is fed from a delivery roll with the web having its front end pasted upon an inserting band. The delivery roll of the auxiliary web is then moved slowly by a lateral displacement to the machine center during entrance of the auxiliary web into the machine together with an inserting band. Thereafter, the front end of the material web, beveled on both sides, is pasted and the material web is thereby introduced into the printing press by means of the auxiliary web.

This type of device has proved cumbersome in operation in that it requires the use of an inserting band and an auxiliary web, both of which must from time to time be replaced.

Another prior art example of the type of device with which the present invention is concerned is disclosed in German Pat. No. 1,229,107 which discloses a device for introducing a material web into a rotary printing press. In this prior art device, band systems are arranged under guides for the material web between individual printing unit. The band systems are guided over band rollers which run loosely upon their axles and the respective band systems which are required are driven by impression rolls of the device in a direction corresponding to the direction of motion of the material web.

However, such a device has been found unsuitable for inserting paper webs into rotogravure printing machines. In such devices, the insertion path in a change of the production of the press is not variable.

In other known embodiments of devices of the type discussed above, chains are utilized to conduct a paper web through the printing assembly. The chains are driven over chain wheels which are mounted in the frames of the machine and which are pulled by a lead-in bar upon which the paper web to be inserted is secured. The chains are moved by means of a hand wheel through the drying hoods of the printing units. However, it has been found that this simple type of device requiring hand operation is no longer adequate for use in machines of the more modern type. This type of device has been found unsuitable for machines which are selectively operable with or without turner bar carridge. Each printing unit requires a lead in bar and the time-consuming operation of fastening the paper web must be repeated in each printing unit.

The present invention is directed toward overcoming many of the drawbacks and problems arising with prior art devices. The invention is intended to provide a device for inserting a material web into a printing unit which requires only a single lead-in bar for all the printing units of a rotary printing press. Thus, time-consuming fastening of the material web need not be repeated in each of the printing units. The device provides transfer and receiving stations which move the lead-in bar with the material web attached thereto automatically from one printing unit to a succeeding printing unit. The device of the present invention includes provision of feeding, transfer and receiving stations with the lead-in bar being alternately locked with the chains of one of the printing units and then being released for engagement with a next succeeding printing unit. The device is of the type provided with a motor drive.

SUMMARY OF THE INVENTION

The arrangement of the present invention is adapted for use in a printing press comprising a plurality of serially arranged printing units each having conveyor chains for conveying the material web therethrough. Each of the conveyor chains is provided with a driving device which consists of a carrier bracket, an opening pawl and a locking bolt. The lead-in bar upon which the material web is attached is provided with an abutment cam surface on both ends and with a recess in which the bolt of the conveyor chain may be engaged. The lead-in bar is also provided with a bore into which a bolt, secured upon the carrier bracket of the conveying chain may be engaged, so that the conveying chains are held fixed with regard to lateral movement. The material web is secured in a loop around the lead-in bar. The lead-in bar is engaged with the driving chains at a feeding station located in front of the form cylinder and the impression cylinder of the printing unit into which the material web is to be introduced. The lead-in bar is held by means of pawls, with series-connected limit switches being actuated as the lead-in bar is engaged into the feeding station of a printing unit. Actuation of the series-connected limit switches commences operation of a rotary field motor of the chain drive device of the respective printing unit so that the lead-in bar is pulled with the material web attached thereto by means of the conveying chains conducted over chain wheels through the printing unit. Thereby, the web is drawn through drying hoods of the printing unit and over guide rolls. To transfer the lead-in bar from one printing unit to the succeeding one, a transfer station and a receiving station are provided, associated with limit switches which terminate operation of the rotary field motor mentioned above. Simultaneously the impression cylinder of the printing unit, in which the material web was introduced so far, is lowered to a distance of 10 mm above the form cylinder of said printing unit, and the rotory field motor driving the conveying chains of the succeeding printing unit is engaged. As a result, the lead-in bar is pulled forward in guide rails by cams on transfer chains until it is engaged to the conveying chains of the next succeeding printing unit at the feeding station of such next succeeding printing unit. In this manner, the lead-in bar is guided through all succeeding printing units of the rotary printing press.

The invention provides a state-of-the-art linear regulating device which operates, in a manner known to those skilled in the art, to compensate for dislocations in paper registry which might occur, for example, due to paper shrinkage or differences in web length at different form cylinder diameters, thereby to maintain constant the printing register of the unit.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DESCRIPTION OF THE PREFERRED EMBODIMENT

Figure 1:
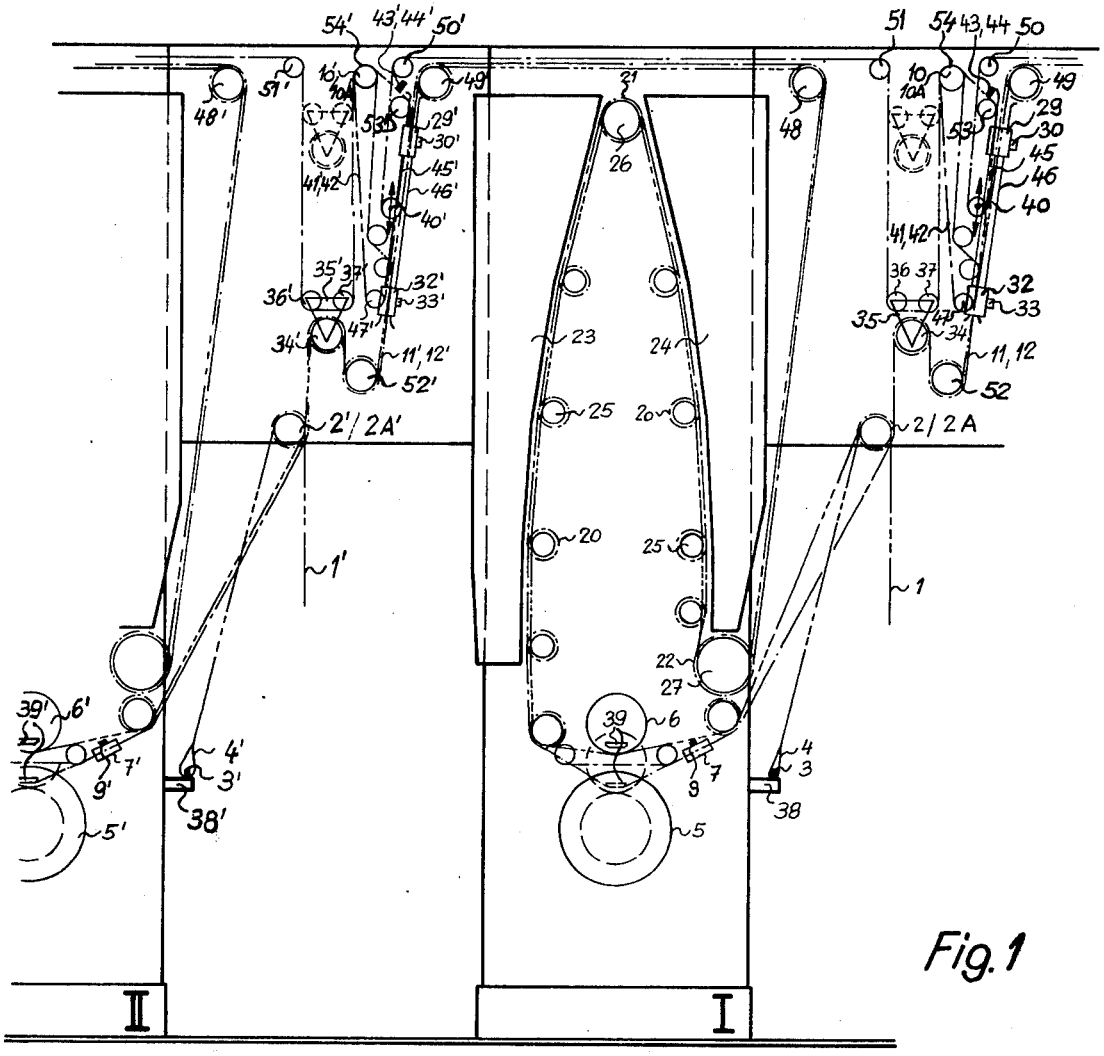
FIG. 1 is a partial side elevation showing the printing unit I of a rotogravure printing press including the device of the present invention.
Figure 2:
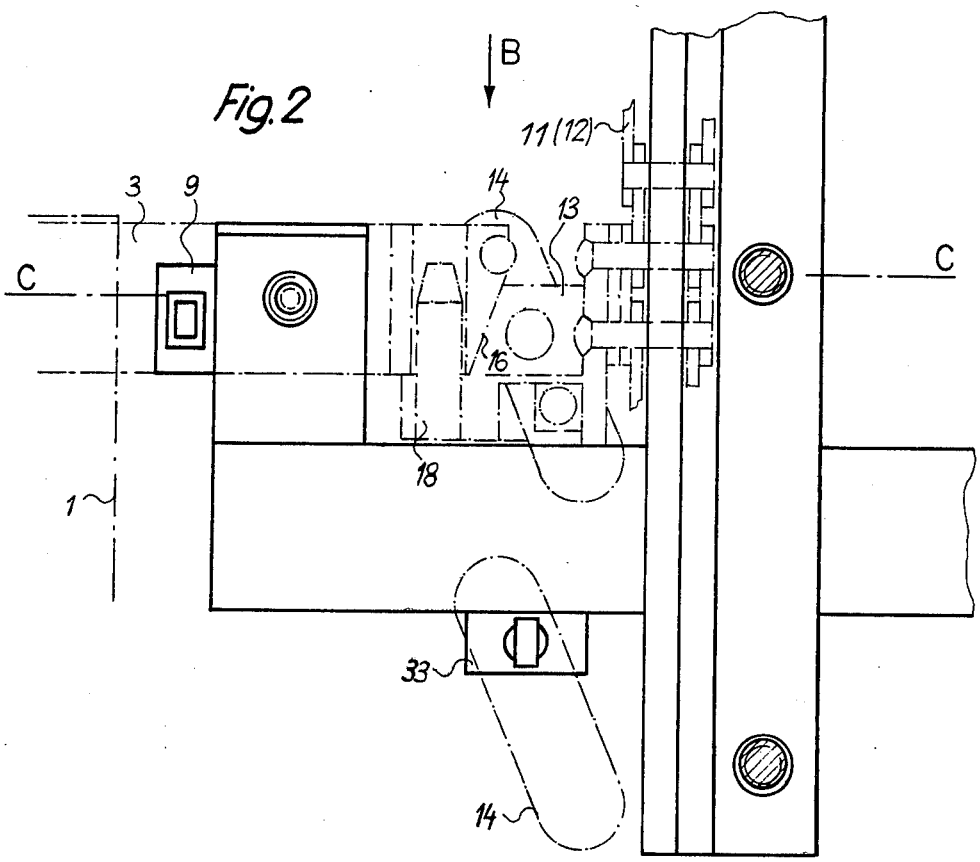
FIG. 2 is a partial sectional view, looking in direction A indicated in FIG. 3, taken through the feeding stations of the machine.
Figure 3:
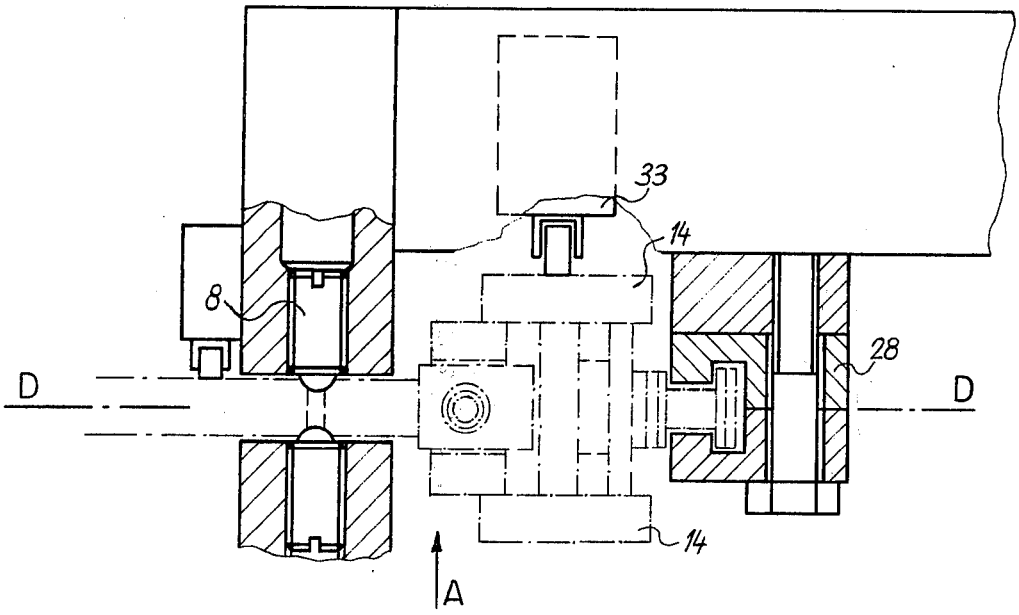
FIG. 3 is a top partial sectional view, looking in direction B indicated in FIG. 2 taken along C—C through the feeding station depicted in FIG. 2.
Figure 4:
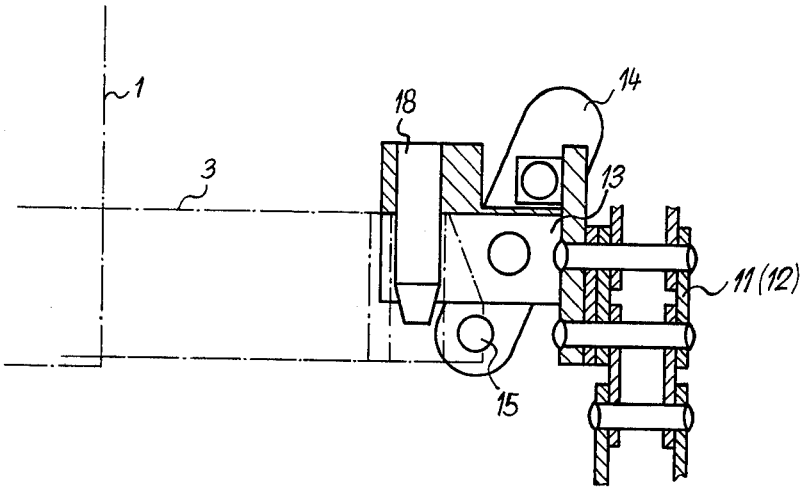
FIG. 4 is a sectional view taken along D—D through the driving device of the present invention showing the chain and opening pawl in a rest position.
Figure 5:
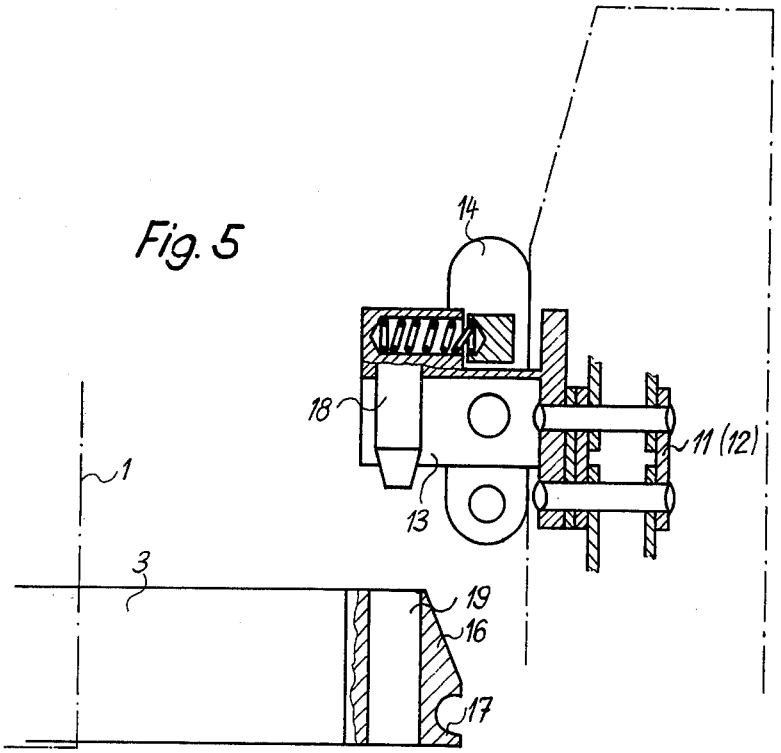
FIG. 5 is a sectional view taken along D—D through the driving mechanism of the invention showing the chain and the opening pawl in the disengaged position, with the lead-in bar disengaged.
Figure 6:
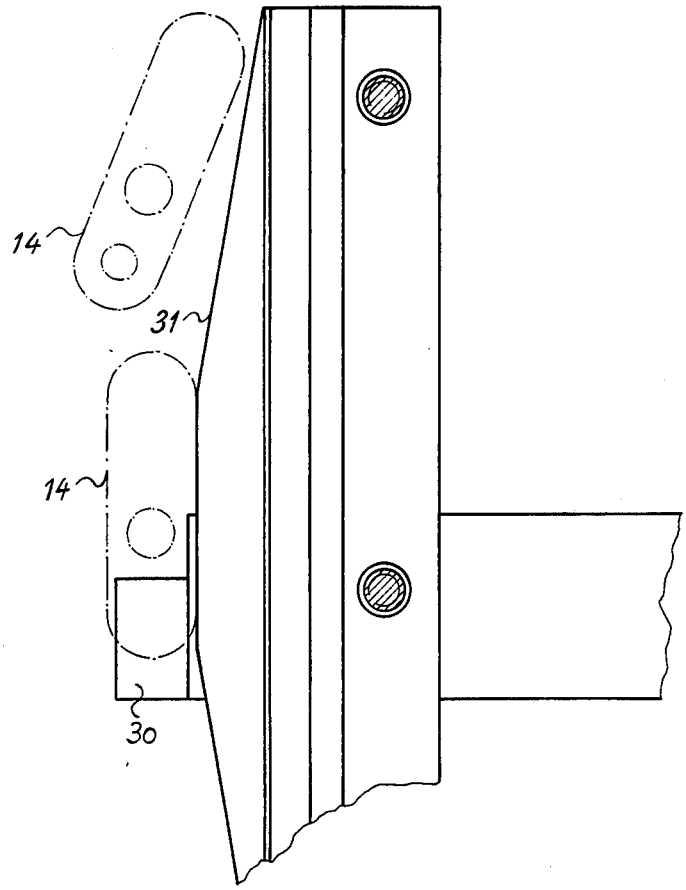
FIG. 6 is a side elevation of an ejector station showing the opening pawl and lifting flanks of the device which operate to disengage the lead-in bar from the chain.
Figure 7:
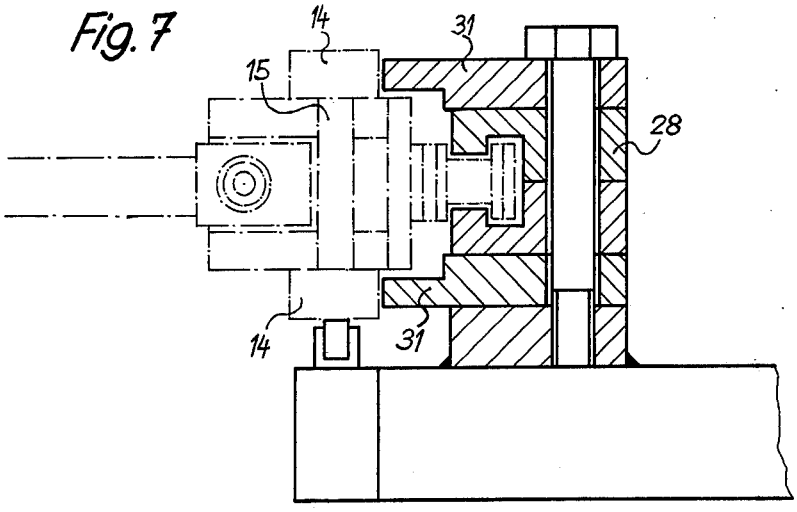
FIG. 7 is a side view of the ejector station depicted in FIG. 6 showing in partial elevation the lifting flanks and guide.

Referring now to FIG. 1, there is shown a material web 1 which is drawn from a reel stand (not shown) and which is then guided over a roller 2. The material web 1 is attached to a lead-in bar 3 in a loop form. This may be accomplished by drawing the material web 1 around the lead-in bar 3 and pasting or otherwise attaching the end of the web back on itself to form the loop 4. After attaching of the material web 1 to the lead-in bar 3, the lead-in bar 3 is engaged in a feeding station 7 by a manual operation. The lead-in bar 3 is introduced into feeding station 7 before passing between the form cylinder 5 and the impression cylinder 6 mounted within the respective printing unit of the printing press. The lead-in bar 3 is held in feeding station 7 by means of pawls 8. On introducing the lead-in bar into the feeding station 7, limit switches 9 will be actuated which will, in turn, effect starting operation of a rotary field motor 10A which energizes the chain drive of the associated printing unit I.

The lead-in bar 3 may be drivingly engaged with conveyor chains 11 and 12 by an engagement and disengagement mechanism formed on the conveyor chains 11 and 12 and on the lead-in bar 3. The parts of the engagement and disengagement device which are formed on the conveyor chains 11 and 12 comprise a carrier bracket 13, an opening pawl 14 and a locking bolt 15 and bolt 18. The lead-in bar 3 includes an abutment cam surface 16, a recess 17 and a bore 19. During operation of the device, the locking bolt 15 comes into abutment against the cam surface 16 of the lead-in bar 3 and the opening pawl 14 is pivotally rotated thereby in order to bring the locking bolt 15 into engagement within the recess 17 of the lead-in bar 3. In order to hold the conveyor chains 11 and 12 against lateral movement thereof and effect correct positioning thereof, a bolt 18 secured upon the carrier bracket 13 moves into the bore 19 of the lead-in bar 3 and becomes engaged therein while the locking bolt 15 is maintained in engagement within the recess 17. During operation, the bolt 18 in the bore 19 on the lead-in bar 3 prevents lateral movement of the conveyor chains 11 and 12 when travelling between engagement and disengagement stations. Thus, a driving connection is effected between chains 11 and 12 and the lead-in bar 3 which has the material web 1 looped thereabout.

In the operation of the asembly of the present invention, the lead-in bar 3 with the material web 1 attached thereto is drawn through the machine by means of the conveying chains 11 and 12. The continuous conveying chains 11 and 12, travel in a clockwise direction from the feeding station 7, between impression cylinder 6 and gravure cylinder 5, over the chain wheels 20, 21 and 25 that appear within the drying hoods 23 and 24. The conveyor chains 11 and 12 then continue round the chain wheel 22 upwards over chain wheels 48 and 49', then through transfer station 29' and turns about chain wheel 40' and passes over chain wheels 50' and 51 and round the chain wheels 36, 37 and 10, onto feeding station 32 chain wheel 52, to complete the circuit the chain travels round chain wheels 34 and 2A, back to the feeding station 7.

The transfer chains 41' and 42' travel in a shorter circuit round motor chain wheel 54', mounted on and next to chain wheel 10' on the same drive shaft. They continue over chain wheels 53' through transfer station 29' then into feeding station 32' of the next printing unit, the transfer chains 41' and 42' continue round chains wheel 47' and returns to chain wheel 54' thus completing the transfer circuit.

The conveyor chains 11 and 12 run through guides 28 which position the conveyor chains 11 and 12 in transfer and stations 29 and feeding stations 32 of the assembly.

In order to disengage the lead-in bar 3 from the chains conveyor 11 and 12, transfer station 29 is provided which includes lifting flanks 31 which operate to engage the pawl 14. As the pawl 14 is passed over the lifting flanks 31, it is pivoted about its pivotal mounting upon the carrier bracket 13 so that the lead-in bar 3 is released from engagement with the conveyor chains 11 and 12. The lead-in bar 3 is released from conveyor chains 11 and 12 in the said manner, then carried down by the transfer chain cams 43' and 44' within guide rails 45' and 46' for the short travel between transfer stations 29' and feeding station 32' where the transfer onto the conveying chains 11' and 12' of the next printing unit takes place at feeding station 32'.

The receiving station 32 is provided which serves to engage the lead-in bar 3 when the material web 1 arrives from a turner bar carriage car (not shown). In the general arrangement shown, it is identical with the feeding station 7. A switch 33 operates to stop the rotary field motor 10A' when turner bar carriages are used. When the assembly is to be operated without turner bar carriages, appropriate passage through the receiving station 32 is insured by the limit switch 33 so that the material web 1 may be freely guided through the next printing mechanism.

The conveyor chains 11 and 12 must run over the linear regulating roller 34 which by its function in the printing process operates to assume any one of a plurality of positions to compensate the paper length between the two printing units at different gravure cylinder diameters. The overall apparatus must provide for compensation for effects which tend to disclocate the printing register of the device. This is enabled, in a manner known to those skilled in the art, by a chain regulating device 35, where the registry compensation is effected over chain wheels 36, 37 with the linear regulating roller 34. It will be understood that this mechanism involves state-of-the-art equipment which basically operates to maintain the printing registry despite the occurrence of things like paper shrinkage and the like.

A support 38 provides horizontal support for the lead-in bar so that the material web 1 may be attached in a right-angled position to the lead-in bar 3 when forming the loop 4.

It will be apparent that, in addition to the embodiment represented in the drawings, other conveying paths are possible with a corresponding arrangement of the paper inserting device.

The paper inserting device of the present invention is designed for fully automatic conveyance of the material web 1. A less expensive design is possible by omitting the transfer chains 41,42 and their drive means, as well as the guide bars 45,46. The transfer station 29 serves as an ejector station and may be mounted anywhere in the path of the conveying chains 11 and 12. The lead-in bar 3 with the material web 1 must then be brought manually from the transfer station 29' to a feeding station 7' of the next adjacent printing unit where it is there again engaged for conveyance through the printing unit.

In the operation of the paper inserting device of the present invention, the material web 1 is either pulled directly from a reel star (not shown) or drawn over a guide roller 2 and then placed in looped form for attachment about the lead-in bar 3 with the loop 4 being formed, for example, with adhesive tape, in order to attach the material web 1 to the lead-in bar 3. Subsequently, the material web 1 with the lead-in bar 3 is manually engaged within the feeding station 7 in front of the gravure cylinder 5 and the impression cylinder 6. The lead-in bar 3 is held and locked by means of the pawl 8.

With feeding of the lead-in bar 3 into the feeding station 7, the limit switches 9, connected in series are actuated thereby starting operation of the rotary field motor 10A thus actuating conveyor chains 11 and 12 of the particular printing unit. At the same time the lead-in bar engagement means mounted on the conveying chains of all the other printing units are moved into the appropriate feeding station, corresponding to feeding station 7 or 7'.

After the start of operation of the conveying chains 11 and 12, the lead-in bar engagement means mounted thereon is brought into operation. The opening pawl 14 which is pivotally mounted upon the carrier bracket 13 is pivotally actuated by engagement of the locking bolt 15 against the abutment cam surface 16 of the lead-in bar 3. As the bolt 15 strikes the cam surface 16, pivoting of the pawl 14 brings the bolt 15 into engagement within the recess 17 on the lead-in bar 3. Simultaneously, the bolt 18 secured upon the carrier bracket 13 engages the bore 19 of the lead-in bar 3 and the conveying chains 11 and 12 are thereby held against lateral movement by the bolt 18 while the bolt 15, locked in engagement with the recess 17, enables the transmission of driving force from the conveyor chains 11, 12 to the lead-in bar 3.

At the termination of this engagement operation, the force of the pawl 8 is overcome and the lead-in bar 3 with the material web 1 is drawn by means of the conveying chains 11 and 12, which are engaged over the chain wheels 20, 21 and 22, through the drying hoods 23,24 while the material web 1 is conducted over the guide rollers 25, 26 and around the roller 27.

In the transfer station 29, disengagement and opening of the engagement mechanism between the conveyor chains 11 and 12 and the lead-in bar 3 is effected by lifting flanks 31 which engage the pawl 14 and cause pivotal motion thereof so that the locking bolt 15 is disengaged from the recess 17 and the lead-in bar 3 is released. At the same time, rotary field motor 10A is stopped by the limit switch 30 which operates simultaneously to effect lowering of the impression cylinder 6 down to about 10cm above the gravure cylinder 5. When using different diameter gravure cylinders 5 the conveyor chains 11 and 12 that run under lugs 39 move accordingly and the spring-mounted chain wheel 40 compensates the different chain lengths, the rotary field motor 10A' is also engaged with limit switch 30.

Transfer chains 41' and 42' with their cam 43' and 44' draw along the lead-in bar 3 with the material web 1 in guides 45' and 46' which hold the lead-in bar 3 laterally. The lead-in bar 3 is drawn to the receiving station 32', where the conveying chains 11', 12' of the next subsequent printing unit operate to assume the conveying operation of the lead-in bar 3 and the material web 1 through the next printing unit.

While a specific embodiment of the invention has been shown and described in detail to illustrate the application of the inventive principles, it will be understood that the invention may be embodied otherwise without departing from such principles.

What is claimed is:

1. A rotary printing press assembly including apparatus for initially threading and conveying continuous webs of material therethrough comprising:

a plurality of sequentially arranged printing units having said material webs pass serially therethrough;

endless chain conveyors for each of said printing units for driving said materials;

a lead-in bar attachable to said conveyors and capable of having said material web attached thereto;

a gravure cylinder and impression cylinder between which said material web is engaged when passing through each of said printing units;

a feeding station for each of said printing units for receiving said web prior to engagement thereof with said gravure cylinder and impression cylinder of each printing unit;

a rotary field motor for driving said endless conveyor chains in each said printing unit during the threading operation;

series-connected limit switches actuated by said lead-in bar for controlling operation of said rotary field motors;

engagement and disengagement means for sequentially connecting said lead-in bar to said chain conveyor at each of said feeding stations of said printing units and for disengaging said lead-in bar when said lead-in bar has passed through said printing units to enable engagement thereof by the chain conveyor of a next succeeding printing unit;

said engagement and disengagement means comprising a carrier bracket mounted on said chain conveyor, a pawl pivotally mounted on said carrier bracket, a locking bolt fixed to said carrier bracket, a cam surface formed on said lead-in bar adapted to be engaged by said pawl, a recess formed in said lead-in bar located to have said pawl guided by said cam surface into locking engagement therewith to effect driving of said lead-in bar by said chain conveyor, and a bore formed in said lead-in bar located to have said locking bolt engaged therein to hold said lead-in bar against lateral movement relative to the driving direction of said chain conveyor;

a transfer station including means for actuating said engagement and disengagement means to disengage said lead-in bar from said chain conveyor when said lead-in bar has passed through a printing unit;

said transfer station including means for transferring said lead-in bar between the chain conveyors of adjacent printing units;

said series-connected limit switches being arranged to be actuated by said lead-in bar to start the rotary field motors of each of said conveyor chains when said lead-in bar introduces said material web thereinto and to stop said rotary field motors when said lead-in bar is transferred to a next adjacent printing unit;

said material web being connected to one end of said lead-in bar and sequentially passed through said plurality of printing units by sequential engagement and disengagement of said lead-in bar with the chain conveyors of each of said printing units.

2. Apparatus according to claim 1 wherein said transfer stations are provided with lifting flanks arranged and configured to engage said pawl to effect pivotal movement of said pawl and disengagement thereof from said recess in said lead-in bar.

3. Apparatus according to claim 2 wherein said transfer station includes switch operated means for bridging the path of said lead-in bar between one printing unit and a next adjacent printing unit.

4. Apparatus according to claim 3 including supports arranged on said pawls of each of said printing units for providing horizontal support for said lead-in bar in order to enable attachment of said material web in a right-angled position to said lead-in bar.

5. Apparatus according to claim 4 wherein the transfer station of each of said printing units of said rotary printing press assembly are provided with transfer chains driven by said rotary field motor associated with each of said printing units in order to form a connection from one printing unit to an adjacent printing unit for enabling drawing of said material web continuously through said entire printing press assembly.

* * * * *